US009676602B2

(12) United States Patent
Cummings et al.

(10) Patent No.: US 9,676,602 B2
(45) **Date of Patent: *Jun. 13, 2017**

(54) AERIAL LIFT WITH SAFETY DEVICE

(75) Inventors: Paul Cummings, Bicester (GB); Kevin Jonathan Gale, Marlow (GB); Allan Malcolm Starck, Little Witcombe (GB)

(73) Assignee: BLUESKY SOLUTIONS LIMITED, Lutterworth (GB)

( * ) Notice: Subject to any disclaimer, the term of this patent is extended or adjusted under 35 U.S.C. 154(b) by 355 days.

This patent is subject to a terminal disclaimer.

(21) Appl. No.: 13/807,414

(22) PCT Filed: Jun. 29, 2011

(86) PCT No.: PCT/GB2011/000976

§ 371 (c)(1),
(2), (4) Date: Aug. 8, 2013

(87) PCT Pub. No.: WO2012/001353

PCT Pub. Date: Jan. 5, 2012

(65) Prior Publication Data

US 2013/0313040 A1 Nov. 28, 2013

(30) Foreign Application Priority Data

Jul. 2, 2010 (GB) ..... 1011136.7

(51) Int. Cl.

| | |
|---|---|
| ***E06C 5/34*** | (2006.01) |
| ***B66F 17/00*** | (2006.01) |
| ***B66F 11/04*** | (2006.01) |

(52) U.S. Cl.

CPC ..... *B66F 17/006* (2013.01); *B66F 11/046* (2013.01)

(58) Field of Classification Search

CPC ..... E06C 7/003; B66F 11/044; B66F 17/006

(Continued)

(56) References Cited

U.S. PATENT DOCUMENTS 4,456,093 A * 6/1984 Finley ..... B66F 17/006 182/18
4,979,588 A * 12/1990 Pike et al. ..... 182/18

(Continued)

FOREIGN PATENT DOCUMENTS

EP 2 096 078 A1 9/2009
EP 2 281 772 A2 2/2011

(Continued)

OTHER PUBLICATIONS

International Search Report for PCT/GB2011/000976 issued Oct. 4, 2011.

(Continued)

*Primary Examiner* — Jerry Redman
(74) *Attorney, Agent, or Firm* — Foley & Lardner LLP

(57) ABSTRACT

A safety device for an aerial lift (10) having operator controls (23) for maneuvering its basket (20) to a desired location and including at least one passive normally closed safety switch (30)(130), e.g. an emergency switch, operable to cut electrical supply and prevent further movement of the basket (20), the safety device comprising a switch activation device (27,160,170) extending across the basket proximate to the controls (23) and an auxiliary safety switch (26) connected in series with the safety switch (30,130) with its contacts C1 normally closed (switch on) unless caused to open (switch off) by operation of the switch activation, thereby cutting off the electrical supply.

19 Claims, 5 Drawing Sheets

(58) Field of Classification Search
USPC ..... 182/18
See application file for complete search history.

(56) References Cited

U.S. PATENT DOCUMENTS

| | | | | |
|---|---|---|---|---|
| 5,021,917 | A | 6/1991 | Pike et al. | |
| 5,121,816 | A | 6/1992 | Curtin | |
| 6,330,931 | B1 * | 12/2001 | Baillargeon et al. | 182/18 |
| 6,405,114 | B1 * | 6/2002 | Priestley B66F | 11/046 182/18 |
| 2011/0209943 | A1 * | 9/2011 | Bowden | 182/18 |
| 2012/0217091 | A1 * | 8/2012 | Baillargeon et al. | 182/18 |

FOREIGN PATENT DOCUMENTS

| | | | |
|---|---|---|---|
| JP | S62-153098 | 7/1987 | |
| JP | S63-142400 | 9/1988 | |
| JP | H04-065300 | 6/1992 | |
| KR | 2020090002074 | 3/2009 | |
| WO | WO 2005118457 A1 * | 12/2005 | B66F 17/00 |

OTHER PUBLICATIONS

Office Action issued in Europe for European Patent Application No. 11739124.3, dated Nov. 24, 2014.

* cited by examiner

AERIAL LIFT WITH SAFETY DEVICE

CROSS-REFERENCE TO RELATED PATENT APPLICATIONS

This application is a national stage of PCT Application No. PCT/GB2011/000976, filed Jun. 29, 2011, which claims priority to United Kingdom Priority Application 1011136.7, filed Jul. 2, 2010. The specification, drawings, claims and abstract of these applications, is incorporated herein by reference in its entirety.

FIELD OF THE INVENTION

This invention relates to an aerial lift with a safety device and in particular to an aerial lift having a cage or basket mounted on the end of an extendable boom.

BACKGROUND OF THE INVENTION

Building construction sites for large buildings frequently employ aerial lift equipment for tiding operatives to elevated locations for, for example, the installation of overhead pipe work during the construction of a building.

A typical aerial lift may comprise it mobile elevated work platform (MEWP) having an extendable boom which has an elevator basket or cage for housing operatives secured to the end of the boom. The basket may contain a control panel which permits a user standing in the basket or cage to manoeuvre the cage to a raised location which facilitates the carrying out of work. The boom is typically raised by a powered hydraulic system on the vehicle.

The controls in elevator baskets typically include a foot operable safety switch which needs to be closed before control on the operator panel may be operated. If the safety device is released the movement of the basket ceases immediately. However in some situations, operators can become trapped between the MEWP basket and an overhead structure before they can either remove their foot from the foot operable safety switch or operate the emergency stop switch. Operators trapped in this way can be crushed, sometimes fatally.

In EP-A-2096 078, the present applicant has described a safety device comprising a tensioned wire or cord arranged proximate to said controls and an auxiliary safety switch connected in series with the foot safety switch. The foot safety switch is an active switch which the operator must maintain in a closed condition in order to operate the controls. In the event that the cord is distorted the auxiliary safety switch cuts off the foot switch closed signal. This causes the movement of the basket to cease immediately.

The present invention provides an alternative safety device.

SUMMARY OF THE INVENTION

According to a first aspect of the present invention there is provided a safety device for an aerial lift having a basket or cage with controls which permit an operator standing in the basket or cage to manoeuvre the basket or cage to a desired location, the controls additionally including at least one passive safety switch, means which, are normally closed to allow the flow of electricity and are operable to cut electrical supply and prevent further movement of the basket or cage, the safety device comprising a switch activation device extending across the basket or cage proximate to said controls and an auxiliary safety switch connected in series with the passive safety switch means, the auxiliary switch having a set of contacts in use held in a closed condition (switch on) unless caused to change to an open condition (switch off) by operation of said switch activation means, thereby cutting off said electrical supply.

By the term passive safety switch means a switch which in an inactive condition is closed to allow the passage of electricity and when activated opens to stop the flow of electricity.

Preferably, the auxiliary safety switch is a solenoid operable switch which is operable to change the contacts to an open condition on receipt of a signal. The auxiliary switch may be located upstream or downstream of the passive safety switch.

The passive safety switch may comprise a manually operable emergency stop switch or alternatively an overload stop switch which cuts power to the basket when a load to be lifted exceeds a predetermined limit.

The auxiliary safety switch may further include a second set of contacts that in use operate an alarm.

The controls for the aerial lift may further include a foot operable safety switch which must be held closed by an operator to activate the controls wherein there is provided a second auxiliary safety switch having a set of contacts in use held in a closed condition (switch on) unless caused to change to an open condition (switch off) by operation of said switch activation means, thereby cutting off said electrical supply. The two auxiliary safety switches are operated by relays controlled by a control box which is connected to a switch activation device.

The control box may be connected to the switch activation device via a signal filter that passes only signals having a predetermined minimum time period.

Preferably the safety device further includes an alarm wherein the signal to the alarm passes through a first timer so that the alarm is operated after a predetermined period. The first timer is conveniently located between the control box and the alarm and permits the alarm to operate intermittently for said time period. Preferably, the control box is also connected to the alarm via a second timer which causes the alarm to operate continuously after said predetermined time period.

The control box may be connected to a reset device allowing the alarm to be switched off within said predetermined time period and as long as pressure has been removed from the switch activation device, resets the control box by resetting both sets of contacts to the closed position (switch-on).

The switch activation means may for example comprise a tens toned wire or cord, as disclosed in EP-A-2096 078, a movable bar which operates the switch when subject to a transverse load or a pressure sensitive safety edge for example a Mayser IP 65. Safety edges are sensors which may be offered as a normally closed contact. If the moving part dial includes the safety edge or bumper strikes an operator (or vice versa) the flexible safety edge is depressed and will send a signal to the switch to open and the automatic movement is stopped. Other types of switch activation means include non-contact devices such as optical sensors activated by light beams and light curtains and devices that operate by differential capacitance.

The alarm may be mounted on the underside of the basket and may comprise a beacon and/or an audible-warning device. The alarm may further include an RF transmitter which sends a radio signal to at least one further alarm remote from the basket and which includes a co-operating receiver which operates said alarms.

The auxiliary safety switch and the alarm are connected to the passive safety switch means through readily connectable and disconnectable pin and socket connectors facilitating the assembly and disassembly of the safety device from the basket for testing, maintenance or replacement.

A second aspect of the present invention provided for an aerial lift having a basket or cage having controls which permit an operator standing in the basket or cage to manoeuvre the basket or cage to a desired location, the controls including a passive safety switch means which is in a generally closed before said controls become operable, and a safety device according to the first aspect of the invention.

The basket may be mounted at one end of an extendable boom, which is typically raised by a powered hydraulic system on the vehicle.

BRIEF DESCRIPTION OF THE DRAWINGS

The invention will be described by way of example and with reference to the accompanying drawings in which.

DETAILED DESCRIPTION OF THE PREFERRED EMBODIMENTS

Figure 1:
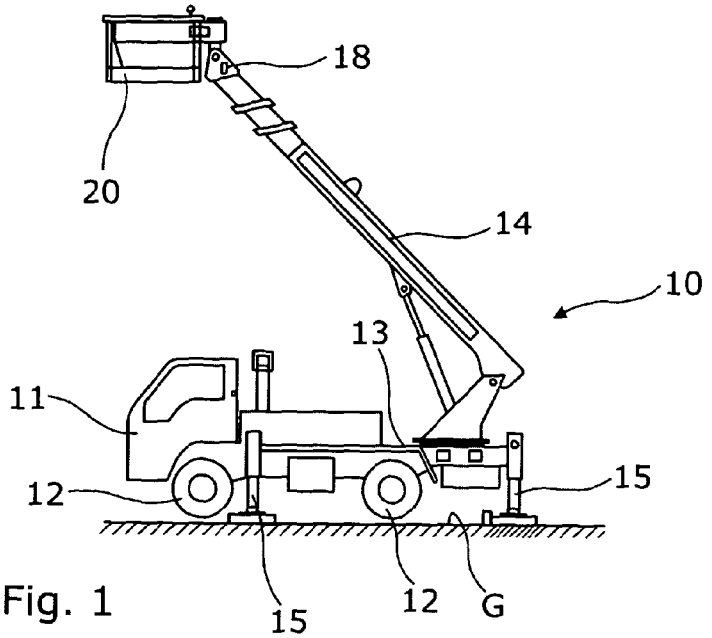
FIG. 1 is a view of a MEWP on an extendable boom.

With reference to FIG. 1 of the drawings, there is shown a MEWP in the form of a self drive mobile lift of any suitable type. The MEWP has a drivable vehicle body 11 having wheels 12 and an extendable boom 14 mounted on a load carrying platform 13 at the rear of the vehicle body. Stabilisers 15 may be provided for steadying the vehicle on the ground G. A basket or cage 20 is mounted on the free end of the boom 14 and the basket, in use, can be raised or lowered and generally maneuvered relative to the ground as is well known. The basket 20 is shown in a raised condition. The boom 14 is raised, lowered, extended, rotated etc. by any suitable means, typically operated by a powered hydraulic system provided on the vehicle body. The boom may be provided with a load sensor 18 which senses the total load on the boom.

The MEWP 10 shown is for example only and any type of aerial lift may be used and the present invention is applicable to any form of aerial lift, including scissor lifts, having a operator carrying basket, cage or platform which is provided with controls in the basket that allow the operator to manoeuvre the basket and sometimes the vehicle, utilising the MEWP power systems.

Figure 2:
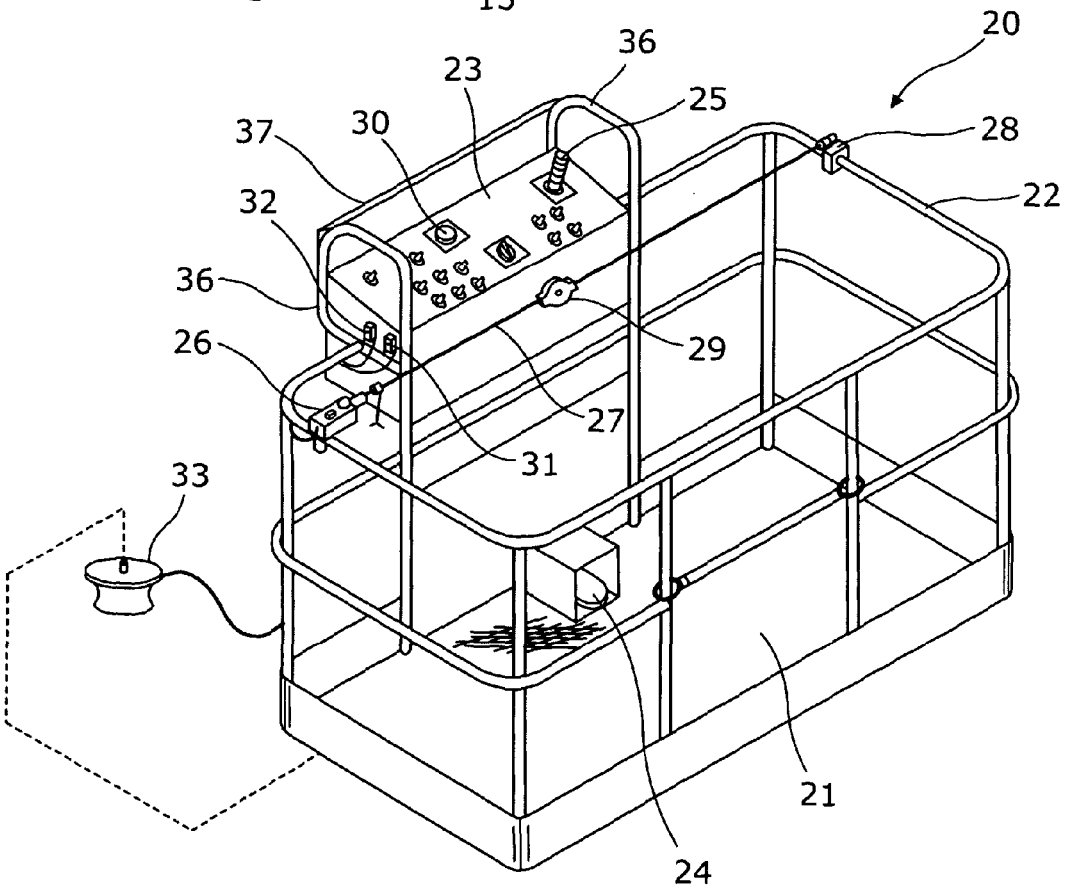
FIG. 2 is an isometric view a basket or cage mounted on the extendible boom shown in FIG. 1 having an auxiliary safety switch and trip wire switch activation means.

With reference to FIG. 2, there is shown the lift or elevator basket 20 having a floor 21 surrounded by a safety barrier 22. The basket 20 is provided with controls 23 whereby an operator standing in the basket 20 can cause the basket to be moved to a desired location. The controls 23, shown as a control panel, may further include a foot operated safety switch 24 which must be depressed before an operator in the basket can cause the lift 10 to move the basket. In the event that the foot safety switch 24 is raised any movement of the basket will cease immediately. The foot switch 24 is typically connected to a control means which shuts off the vehicle's power supply to prevent movement of the basket if the foot switch is not closed. An emergency stop 30 is provided on the control panel 23 which is connected to a control means V, typically a valve, and will also shut off the power supply when activated to prevent movement of the basket. The general movement of the basket is controlled by a control lever 25. The control panel 23 may be partially protected by protection bars 36 and a back plate 37.

An auxiliary safety device comprising a switch 26, a switch activation device 27 in the form of a trip cord 27 and alarm 33 is also provided on the basket 20. The auxiliary safety switch 26 is mounted on the safety barrier 22 to one side of the control 23. The switch 26 is connected via electrical connector 31 and circuitry within the control 23 to the emergency stop 30 and is operable to cut-off the power supply from the emergency stop 30 which has the same effect as the emergency stop being activated. A suitable switch is a Guardmaster lifeline 4 available from Allen & Bradley. The switch 26 includes a first set of contacts C1 (see FIG. 3) which are closed unless activated. Other suitable safety switch devices may be used for example solenoid operated devices such as relays.

The tension load is applied by the tensioned trip wire or cord 27 which extends across the front of the control 23 and is fixed to a support 28 mounted on the safety barrier 22 on the far side of the control 23. The cord 27 may be held in tension by an adjustable tensioner 29. The trip cord 27 must be positioned so as to allow normal operation of the control 23 but be tripped by an operator in the event that the operator is disabled and falls or collapses within the basket. In this example the wire runs across the front of the control from which it is spaced by a suitable distance.

The auxiliary switch 26 also includes a second contact set C2 (see FIG. 3) which are connected via connector 32 to an emergency alarm 33 which is mounted on the basket 20 in a visible location, preferably on the underside of the floor 21. The alarm 33 may be a visual and/or audible alarm and may include an RF transmitter which send a radio signal to at least one further alarm (not shown) remote from the basket 20 and which includes a co-operating receiver which operates said further alarm.

Figure 3:
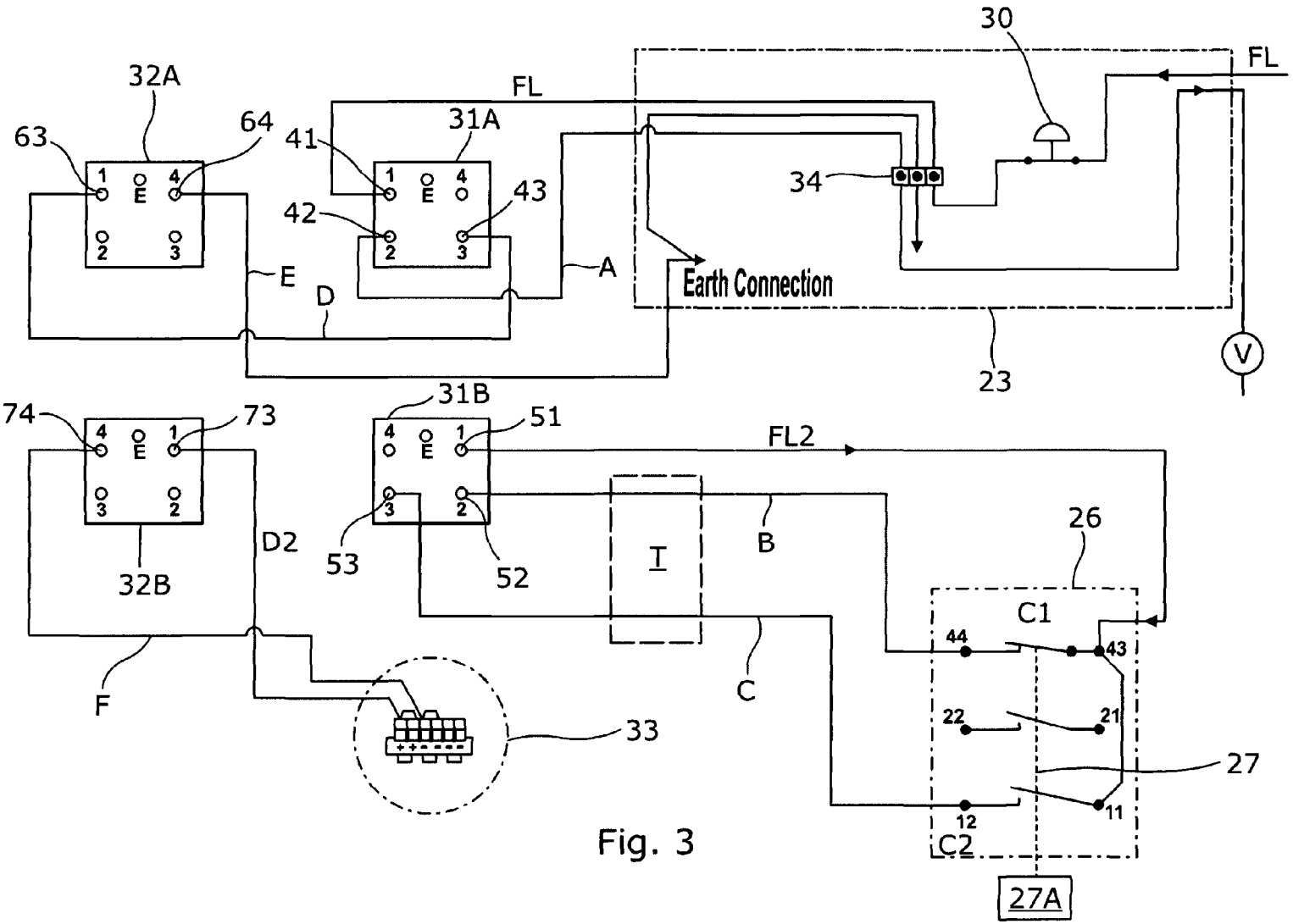
FIG. 3 is a wiring diagram for connection of the safety device to a first passive safety switch means in the circuit of the control panel in the basket and shown with auxiliary switch in a operative closed condition.

Referring also to FIG. 3, there is shown the electrical circuit for the safety device. The power feed line FL to the emergency stop 30 is diverted downstream thereof to a socket 41 within the socket part 31A of connector 31. A cooperating pin 51 of the plug part 31B of connector 31 is connected via electrical cable FL2 to contacts C1 and C2 in parallel. The other sides of contacts C1 and C2 are connected via electrical cable B and C to separate pins 52, 53, respectively on the plug part 31B. The pins 52, 53 are connectable with cooperating sockets 42 and 43 on the socket part 31A. The socket 42 is connected via electrical wire A and connection block 34 to the valve means V. The other socket 43 is connected by electrical cable D to a socket 63 of the socket part 32A of connector 32. A second socket 64 of the socket part 32A is connected by cable E to Earth or ground. The socket 63 is connectable with a co-operating pin 73 on the ping part 32B of connector 32. The pin 73 is connected by cable D2 to the alarm 33. The alarm 33 is grounded via cable F connected to pin 74 on the plug part 32B. The pin 74 co-operates with socket 64 for grounding the alarm 33.

As shown in FIG. 3, the trip cord 27 (represented by dotted lines) is under tension and the auxiliary switch 26 is set with contacts C1 closed and contacts C2 open. In this condition, the power feed line FL is connected through connector 31 and contacts C1 to the control means V permitting operation of the basket. The contact C2 is open cutting off power to the alarm 33.

Figure 4:
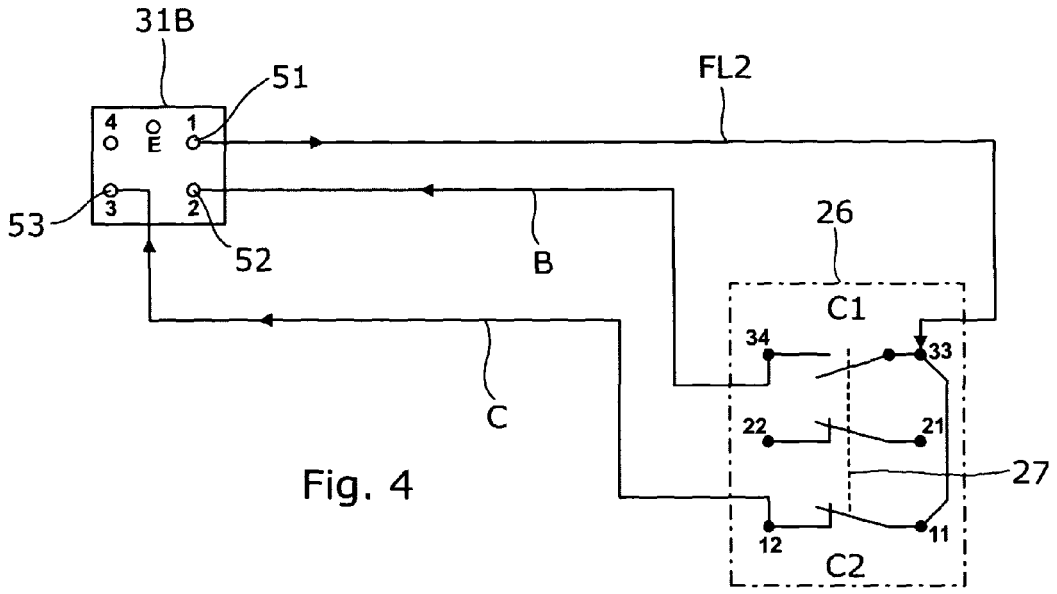
FIG. 4 is a portion of the wiring diagram shown in FIG. 3 showing the auxiliary switch having been activated.

With reference to FIG. 4, when the trip wire 27 is activated, the contacts C1 and C2 within the auxiliary switch 26 are caused to move so that C1 becomes open and C2 closes. In this state, the power feed line FL2 is disconnected from the pin 52 of the connector 31 and the power feed line FL2 is connected to the pin 53 of the connector 31. In this state, power is supplied to the alarm 33 and disconnected from the control valve V thus immediately immobilising the movement of the basket 20.

Figure 5:
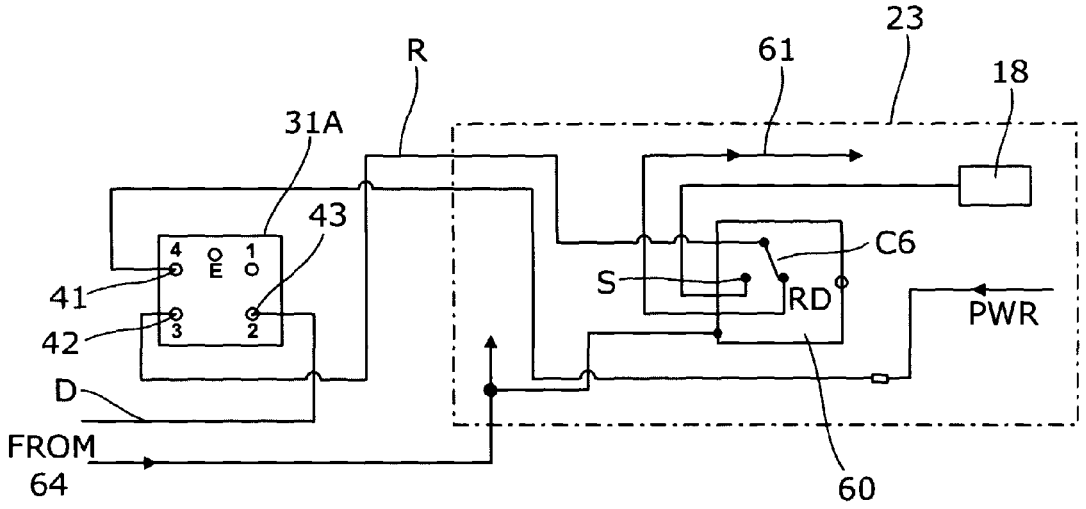
FIG. 5 shows a second embodiment of the invention showing the connection of the safety device to a second passive safety switch means in the circuit of the control panel.

With reference to FIG. 5, there is shown the electrical circuit for a second embodiment of the safety device. The power feed line PWR to an overload sensor 18 is diverted upstream thereof to the socket 41 within the socket part 31A of connector 31. A cooperating pin 51 of the ping part 31B of connector 31 is to the auxiliary switch 26 as previously described. The other socket 43 is connected by electrical cable D to a socket 63 of the socket part 32A of connector 32 also as described above. The socket 42 is connected via electrical wire R to an overload stop switch 60. The output 61 from the overload stop switch is connected to valve means V. The overload stop switch 60 has contacts C6. The operation of the auxiliary safety switch 26 to open contacts C1 cuts off power via wire R to the overload stop switch 60 and to the valve means V.

The overload stop switch 60 is operated by a solenoid S, or some other suitable device, connected to the overload sensor 18. When the sensor 18 senses an overload a signal is sent to the solenoid S to open the contacts C6 and thereby cut-off power to the valve means V.

Figure 6:
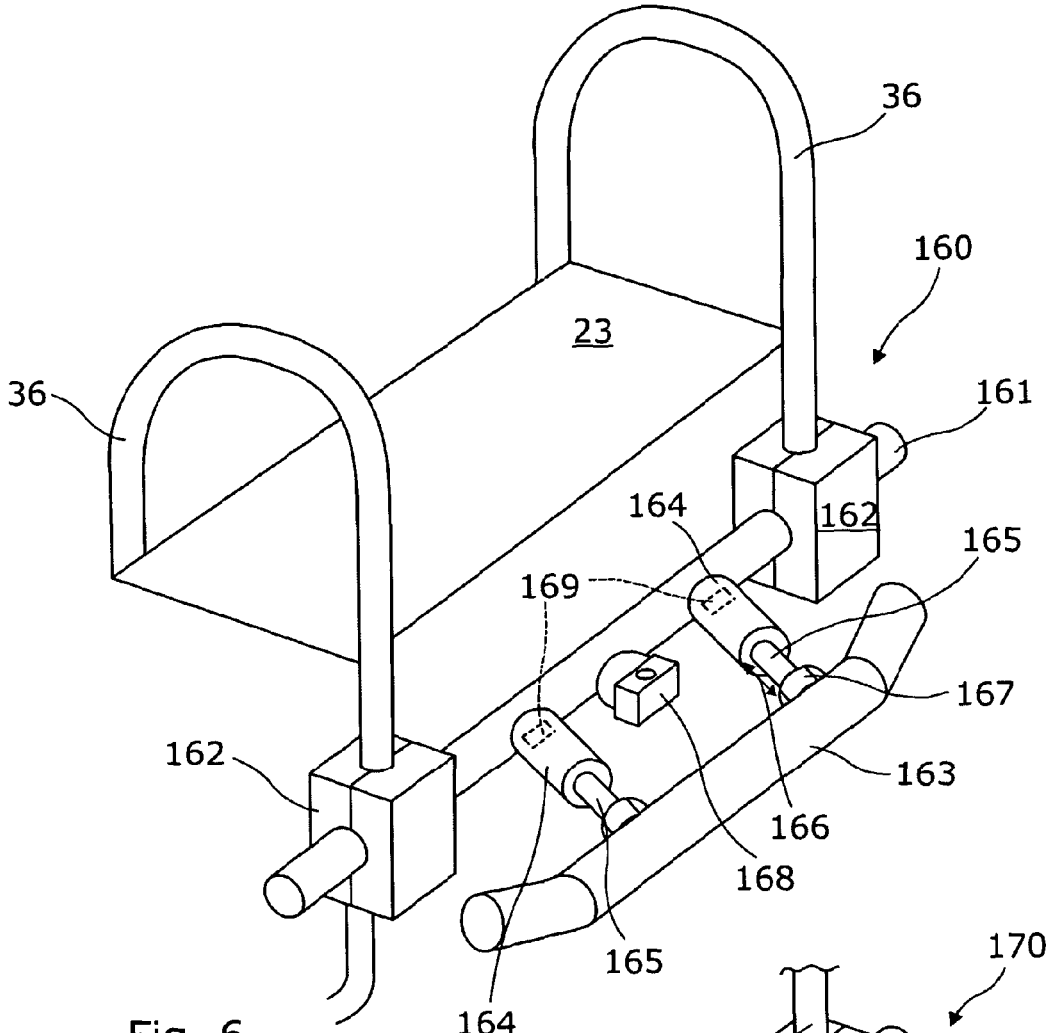
FIG. 6 shows an isometric view of a portion of the basket shown in FIG. 2 showing an alternative switch activation means in the form of a bar, FIG. 7 show an isometric view of a portion of the basket shown in FIG. 2 showing yet another switch activation means.

With reference to FIG. 6, the auxiliary switch 26 is mounted on or within the control panel 23 and is operated by an alternative switch activation means 160. The contacts C1, C2 within the auxiliary switch 26 are not operated by a tension wire but are operated via a solenoid 27A (shown in chain dotted outline in FIG. 3) and the activation device 160 sends a signal to activate the solenoid. The switch activation means 160 comprises a support bar 161 mounted across the front of the control panel 23. The support bar 161 is mounted on the protection bars 36 by means of brackets 162. The support bar 161 has a pair of spaced apart, cylindrical housings 164 thereon. Reciprocating pins or pistons 165 are guided and supported tor movement in the housings 164 and a safety bar 163 is mounted on the pistons for relative movement of the safety bar 163 away horn and towards the support bar 161. At least one of the two housings 164 includes a micro-switch 160 operated by inward movement of the respective piston 165.

The pistons 165 are spring loaded outwardly of the housing by for example coaxial springs 166 acting between the bar 163 and the respective housing 164. The load on the springs 166 may be adjusted by means of a screw adjuster ring 167 so that the bar 163 requires a pre-set minimal load before it is pushed inwardly towards the support bar 161 to activate the micro-switch(es) 169 and send a signal to the solenoid 27A, to operate the auxiliary safety switch 26. A reset button 168 is located on the support bar 161 for resetting the auxiliary safety switch 26 after activation.

Figure 7:
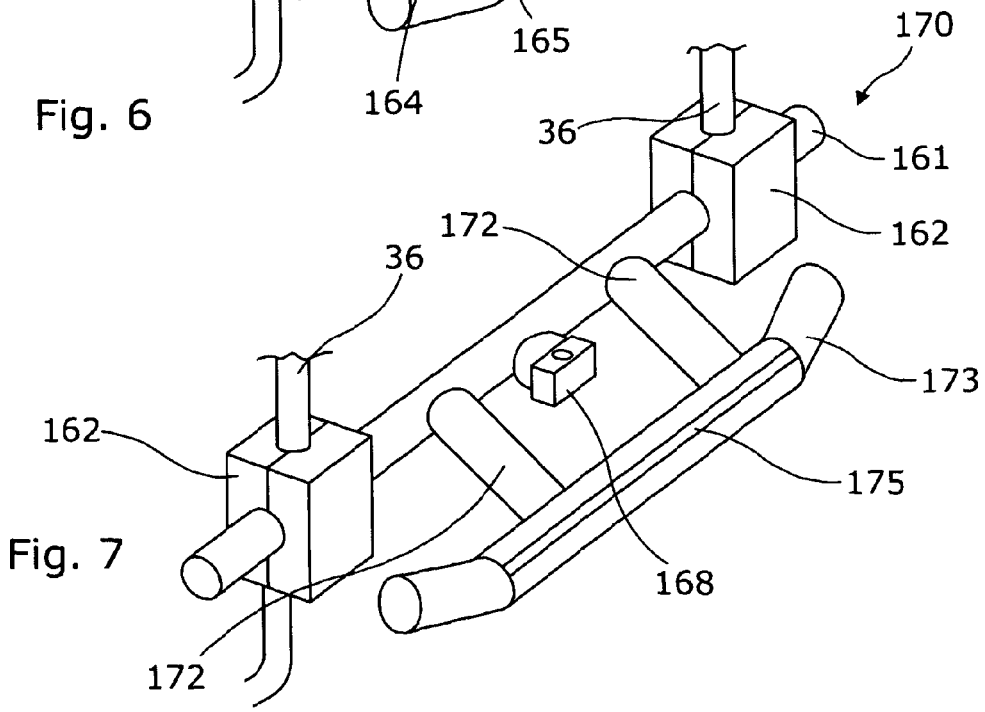

With respect to FIG. 7 there is shown yet another switch activation means 170. The switch activation means 170 has components in common with the switch activation means 160, and comprises a support bar 161 mounted across the front of the control panel 23. The support bar 161 is mounted on the protection bars 36 by means of brackets 162. The support bar 161 is connected to a rigid a safety bar 173 mounted on the support bar 161 by a pair of spaced apart supports 172. A safety edge 175 or bumper is mounted on the front of the safety bar 173. Safety edges and bumpers are known and can be classified as "trip" devices. In general the safety edge and safety bumper are particularly suitable tor use on machines which stop immediately after removal of power. A complete safety edge consists of an aluminium rail, the safety contact, and the safety contact strip. The special shapes of the safety edge (rubber profile) protects the safety contact strip from damage. Safety bumpers operate in the same manner as safety edges with the only constructional difference being the addition of foam rubber covered in polyurethane to protect any object that comes in contact with the safety bumper. A signal from the safety edge causes the operation of the solenoid 27A.

The auxiliary switch 26 may include signal filter device F downstream of C1 and C2 which inhibits a change in signal, i.e. power signal, from the first and/or second set of contacts until a desired time period has elapsed so as to reduce or prevent triggering of the safety switch due to inadvertent loads acting on the tensioned cord.

It will be appreciated that many other different forms of switch activation means may be used for example, those triggered by optical sensors sensing laser beams, light curtains etc., and other non contact sensors like capacitance differential devices. Any of the switch activation devices may be utilised in combination with the emergency stop 30.

Figure 8:
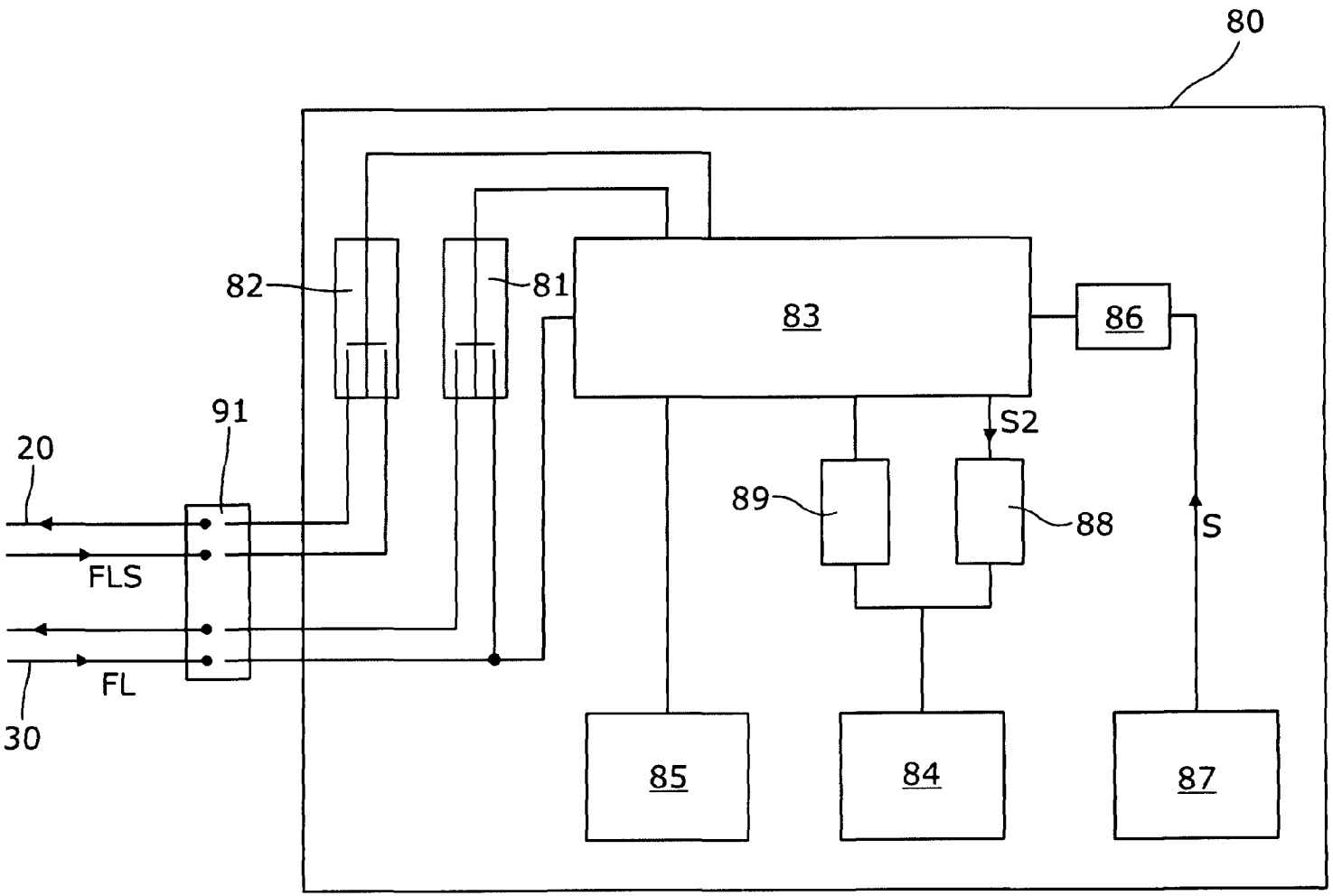
FIG. 8 is a schematic diagram showing an alternative embodiment of the invention including signal filters.

With reference to FIG. 8, there is shown a further embodiment of the safety device 80 in which the power feed line FL to the emergency stop 30 is diverted to a connector 91 which serves to connect the device 80 into the controls 23. A second power feed line FLS to safety foot switch 24 is also diverted to the connector 91. The safety device 80 includes a pair of auxiliary safety switches 81, 82 in the form of relays 81, 82 and the power feed FL to the emergency stop 30 is connected to the relay 81 and the power feed FLS to the footswitch 24 is connected to the relay 82. The two relays are connected to a control box 83 which can cause the relays 81, 82 to be closed to allow electricity to flow to the emergency stop 30 or open thereby cutting the flow of electricity to the controls 23.

The control box 83 may include a programmable processor and is connected to a switch activation device 87, similar to the safety edge 170 described earlier, via a signal filter 86. The control box 83 is also connected to an alarm 84 via a pair of timers 88, 89 and to a reset device 85.

The control box 83 is also connected to the power input FL to the emergency stop 30.

The relays 81, 82 are normally held in closed condition allowing power to pass through the relays 81, 82 to the emergency stop 30 and the footswitch 24. In the event that the safety edge 87 is triggered a signal S is sent to the control box 83 via a signal filter 86. The signal filter 86 removes signal shorter than a pre-set time period, e.g. 0.6 seconds. If the signal S is greater than the pre-set time period e.g. 0.6 seconds or longer, the control box 83 operates the two relays 81, 82 to open and cut power to the foot switch 24 and emergency stop 30 causing movement of the basket 20 to stop immediately. A signal S2 is also sent to the alarm 84 via the signal timer 88 to cause the alarm to "pulse" for a second pre-determined time period say 10 seconds.

The control box 83 is connected to the reset button 85 and if the load has been removed from the safety edge 87, the operation of the reset device stops the alarm and re-closes the relays 81, 82 which allows the controls 23 to again operate the lift.

After the second pre-set time period as measured by timer 88, the third timer 89 causes the alarm the go into a continuous mode and keeps the controls in an inactivate condition. The third timer 89 may operate a switch or relay.

The controls cannot be operated until the pressure/load is removed from the safety edge and the reset device 85 is activated.

When the controls 23 are first switched on the control box can go through a self diagnostic routine and initially sound the alarm by opening the relay contacts 81, 82. The reset button 85 is then activated to close the relay contacts 81, 82 and make the device ready for use.

The invention claimed is:

1. A safety device for an aerial lift having a basket or cage with controls which permit an operator standing in the basket or cage to manoeuvre the basket or cage to a desired location, the controls additionally including at least one passive safety switch means which are normally closed to allow the flow of electricity and are operable to cut electrical supply and prevent further movement of the basket or cage and a foot operable safety switch which must be held closed by an operator to activate the controls, the safety device comprising a switch activation device positioned within the basket or cage, said switch activation device comprising a pressure sensitive safety edge extending across the basket or cage proximate to said controls;

a first auxiliary safety switch connected in series with the at least one passive safety switch means, the first auxiliary safety switch having a set of contacts in use held in a closed condition unless caused to change to an open condition by operation of the switch activation device, cutting off said electrical supply to the controls through said at least one passive safety switch means; and a second auxiliary safety switch connected in series with said foot operable safety switch, the second auxiliary safety switch having a set of contacts in use held in a closed condition unless caused to change to an open condition by operation of the switch activation device, thereby cutting off the electrical supply to the foot operable safety switch and thus communication between the foot operable safety switch and the controls, resulting in deactivation of the controls.

2. A safety device as claimed in claim 1 wherein the first auxiliary safety switch is a solenoid operable switch which is operable to change the contacts to an open condition on receipt of a signal.

3. A safety device as claimed in claim 1, wherein the first auxiliary safety switch is located downstream of the passive safety switch.

4. A safety device as claimed in claim 1, wherein the first auxiliary safety switch is located in the power feed to the passive safety switch upstream thereof.

5. A safety device as claimed in claim 4, wherein the passive safety switch comprises a manually operable emergency stop switch.

6. A safety device as claimed in claim 1, wherein the passive safety switch is an overload stop switch which cuts power to the basket when a load to be lifted exceeds a predetermined limit.

7. A safety device as claimed in claim 1, wherein the first auxiliary safety switch includes a second set of contacts that in use operate an alarm.

8. A safety device as claimed in claim 1 wherein the first auxiliary safety switch and the second auxiliary switch are operated by relays controlled by a control box which is connected to the switch activation device.

9. A safety device as claimed in claim 8, wherein the control box is connected to the switch activation device via a signal filter that passes only signals having a predetermined minimum time period.

10. A safety device as claimed in claim 8, further including an alarm, wherein the signal to the alarm passes through a signal filter so that the alarm is operated after a predetermined period.

11. A safety device as claimed in claim 10, wherein a timer is located between the control box and the alarm and permits the alarm to operate intermittently for a pre-set time period.

12. A safety device as claimed in claim 11 wherein the control box is connected to a reset device allowing the alarm to be switched off within said pre-set time period provided that the switch activation device has ceased operation.

13. A safety device as claimed in claim 11, wherein the control box is connected to the alarm via a second timer which causes the alarm to operate continuously after said pre-set time period.

14. A safety device as claimed in claim 3, wherein the passive safety switch comprises a manually operable emergency stop switch.

15. An aerial lift comprising a basket or cage having controls which permits an operator standing in the basket or cage to manoeuvre the basket or cage to a desired location, the controls including a passive safety switch means which is in a generally closed condition before said controls become operable, a foot operable safety switch which must be held closed by an operator to activate the controls, and a safety device as claimed in claim 1.

16. An aerial lift as claimed in claim 15, wherein the basket or cage is mounted at one end of an extendable boom.

17. An aerial lift comprising a basket or cage having a controls which permits an operator standing in the basket or cage to manoeuvre the basket or cage to a desired location, a foot operable safety switch which needs to be closed before said controls become operable, and a safety device as claimed in claim 7.

18. An aerial lift as claimed in claim 17, wherein the alarm is mounted to the underside of the basket or cage.

19. An aerial lift as claimed in claim 18, wherein the basket or cage is mounted at one end of an extendable boom.

* * * * *